US006729317B2

(12) United States Patent
Kraus

(10) Patent No.: US 6,729,317 B2
(45) Date of Patent: May 4, 2004

(54) IGNITION SYSTEM WITH AN IGNITION COIL

(75) Inventor: Markus Kraus, Jenbach (AT)

(73) Assignee: Jenbacher Aktiengesellschaft, Jenbach (AT)

( * ) Notice: Subject to any disclaimer, the term of this patent is extended or adjusted under 35 U.S.C. 154(b) by 44 days.

(21) Appl. No.: 09/976,812

(22) Filed: Oct. 12, 2001

(65) Prior Publication Data

US 2002/0121272 A1 Sep. 5, 2002

(30) Foreign Application Priority Data

Oct. 16, 2000 (AT) ..... 1763/2000

(51) Int. Cl.[7] ..... F02P 3/00
(52) U.S. Cl. ..... 123/606; 123/644
(58) Field of Search ..... 123/606, 644, 123/650; 324/378, 380

(56) References Cited

U.S. PATENT DOCUMENTS 5,617,032 A * 4/1997 Inagaki ..... 324/399
5,675,072 A * 10/1997 Yasuda et al. ..... 73/35.08
5,914,604 A * 6/1999 Bahr et al. ..... 324/399
5,925,819 A * 7/1999 Yoshinaga et al. ..... 73/117.3
5,979,406 A * 11/1999 Aoki et al. ..... 123/406.37
6,000,276 A * 12/1999 Mogi et al. ..... 73/35.08
6,155,241 A * 12/2000 Hohner et al. ..... 123/625
6,186,129 B1 * 2/2001 Butler, Jr. ..... 123/620
6,305,365 B1 * 10/2001 Maeoka et al. ..... 123/604
2002/0145429 A1 * 10/2002 Yorita et al. ..... 324/380

FOREIGN PATENT DOCUMENTS

DE 196 12 201 A1 10/1996
DE 195 24 541 C1 12/1996
DE 019614288 C1 * 8/1997 ..... F02D/41/22
DE 196 10 862 A1 9/1997
EP 547 258 A1 6/1993
JP 53090531 A 8/1978
JP 55060664 A 5/1980
JP 01008367 A 1/1989
JP 10018952 A 4/1998

* cited by examiner

*Primary Examiner*—Mahmoud Gimle
*Assistant Examiner*—Hai Huynh
(74) *Attorney, Agent, or Firm*—Lorusso Loud & Kelly LLP

(57) ABSTRACT

An ignition system is disclosed that is capable of configuring the development or pattern of the ignition spark in a freely pre-selectable manner. The system has an ignition coil that is supplied on the primary side by a high frequency source (HF Source) that is pulse width modulated. The pulse width is regulated based upon the measured actual value of the current on the secondary side of the ignition coil and upon a pre-selected reference value development of the current amplitude during an ignition spark.

5 Claims, 3 Drawing Sheets

IGNITION SYSTEM WITH AN IGNITION COIL

BACKGROUND OF THE INVENTION

Figure 1:
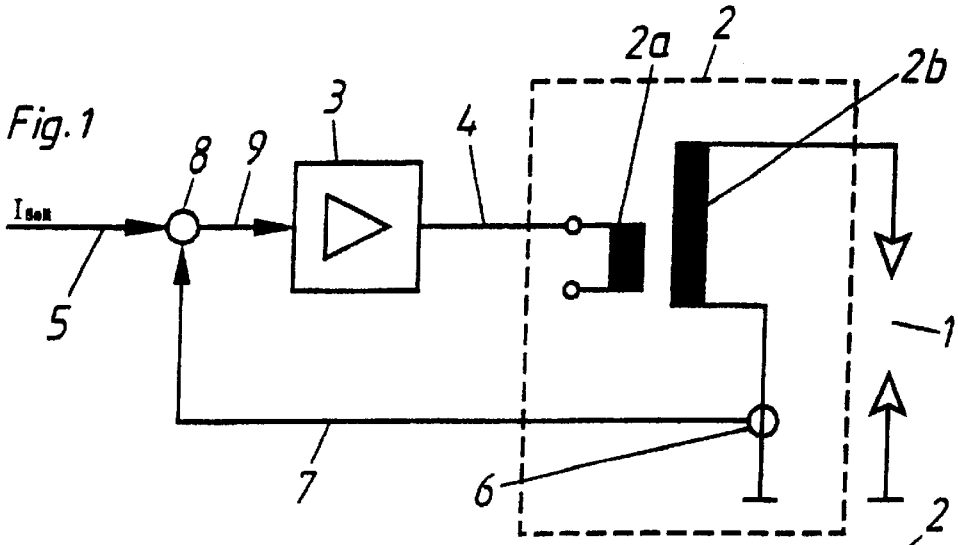

The present invention relates to an ignition system with an ignition coil that is supplied at the primary side by a high frequency source (HF source), wherein the voltage provided by the HF source is pulse width modulated and a means for picking up the secondary side current (actual value) is provided.

In EP 0 547 258 A1 the peak value of the current flowing in the spark plug or secondary electrical circuit at the time of ignition or shortly thereafter is compared with a reference value by regulating the closing time. If, for any reason—transformation ratio or condition of the ignition coil, plug or cable etc—the peak value is greater or less than the predetermined reference value, the closing time of the primary electric circuit is correspondingly shortened or lengthened.

Modern ignition systems are therefore no longer content with producing an ignition spark, but instead want to configure the development or pattern of the ignition spark for each individual ignition spark in order to obtain optimum combustion. It is already known to use a high frequency source as the primary side supply for an ignition coil and to pulse width modulate the voltage provided by the high frequency.

From documents JP 55060664 A, JP 53090531 A and JP 01008357 A moreover, ignition control means are known wherein the primary side feed signal is controlled dependent upon the secondary side measurement signals. In JP 55060664 A, control takes place on the primary side when the secondary side current is less than a previously defined threshold value. In JP 5309031 A, the secondary side current strength and combustion time is enlisted as a control value. In JP 01008357 A, a pulse width control system is provided to control the primary side switching on the basis of an output signal picked up on the secondary side.

SUMMARY OF THE INVENTION

According to the invention, the aim is now to afford an opportunity to configure the development or pattern of the ignition spark in a freely pre-selectable manner.

It is thus provided according to the invention that a regulating means is provided that regulates the pulse width depending on the picked-up actual value of the current on the secondary side of the ignition coil and on a pre-selected reference value development of the current amplitude during an ignition spark. In this way a reference value development or pattern for the ignition current during an ignition spark can be pre-selected. The regulating means picks up the actual value of the current during the ignition spark, and then, by means of the pulse width modulation, influences the current output such as to substantially retain the reference value development in terms of current amplitude.

In addition, or alternatively it can be provided that the voltage regulation is such that the secondary side ignition voltage is limited to a maximum value. With such regulation, it is possible in particular to obtain a voltage limit for the secondary side ignition voltage.

Finally, it should be noted that a variant in the above-mentioned embodiments exists wherein the frequency of the high frequency source is matched to the resonance frequency of the ignition circuit.

DETAILED DESCRIPTION OF THE INVENTION

Further advantages and details of the invention will be explained in more detail with reference to the following drawings.

FIGS. 1 to 4 each show different embodiments of an ignition system according to the invention. In the ignition system shown in FIG. 1, the spark plug is labelled 1 and the ignition coil 2. This ignition coil has a secondary circuit 2*b* and a primary circuit 2*a*. The primary circuit is supplied by a high frequency source 3 that outputs a pulse width modulated voltage, typically in the range of 50 to 100 kH on the line 4. On the line 5, a reference value current development or pattern can be freely pre-selected, as is shown, for example, in FIG. 5 in the second diagram ($I_{soll}$). The primary side voltage output on the line 4 (shown without spark plug ignition) is pulse width modulated, and shown in FIG. 5 as $U_{PRIMAR}$. The resulting secondary side high voltage $U_{HS}$ is shown in the fourth diagram of FIG. 5. The secondary side current IHS is evident from the last diagram of FIG. 5.

In accordance with the invention, according to FIG. 1, a means 6 for picking up the secondary side current is provided on the secondary side 2*b* of the ignition coil 2 (for example, implemented as an instrument shunt). The secondary side actual value of the current is then transferred via the line 7 to the regulating means 8, which outputs a control signal to the HF source via the line 9. This control signal 9 substantially provides the pulse width with which the HF source, when there is a pre-selected, preferably adjustable, frequency on the line 4, then outputs the actual primary voltage to the ignition coil 2.

Figure 2:
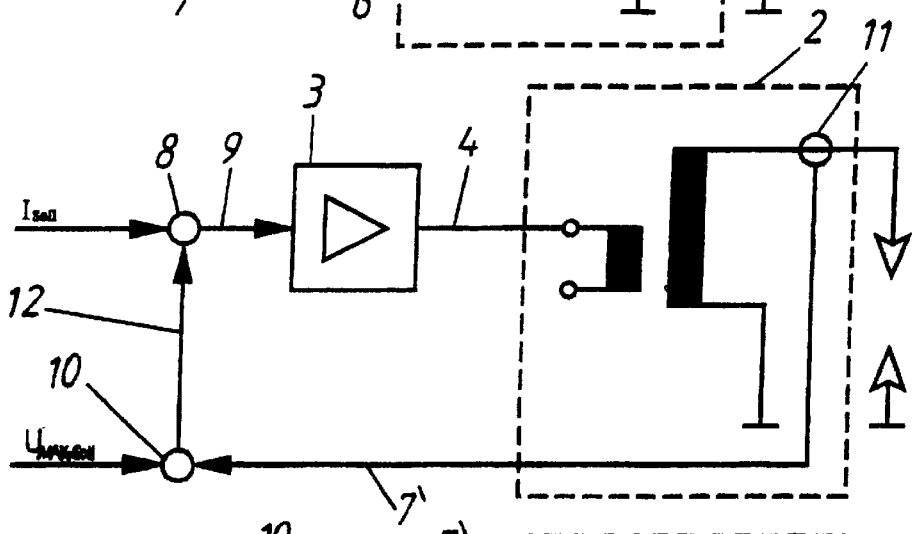

In the embodiment shown in FIG. 2, instead of the current regulation of FIG. 1, voltage limiting regulation is provided. For this, there is provided a means 11 for picking up the secondary side voltage. In the simplest case, this means 11 is a connecting node for the line 7'. This signal arrives at a regulating means 10 that presets a comparison with a maximum voltage value. When this is exceeded, a signal is given on the line 12 to the regulating means 8 which leads to a reduction in the pulse width and thus to a reduction of the secondary voltage.

Figure 3:
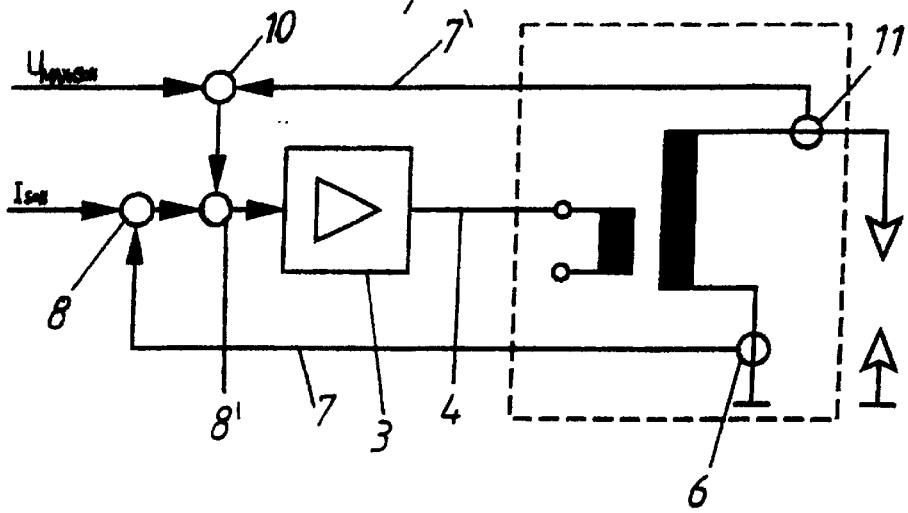

As FIG. 3 shows, the current regulation of FIG. 1 can also be combined with the voltage limiting regulation of FIG. 2, wherein for current regulation a first regulator 8 is provided, and for voltage limiting regulation a second regulator 8'.

Figure 4:
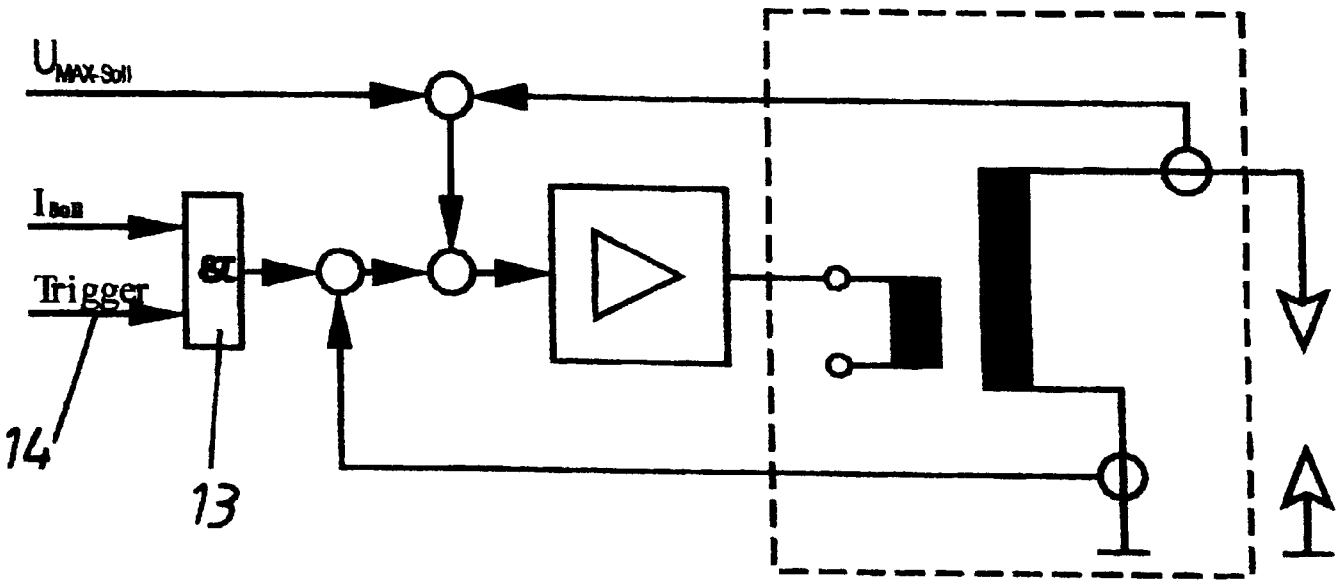
Figure 5:
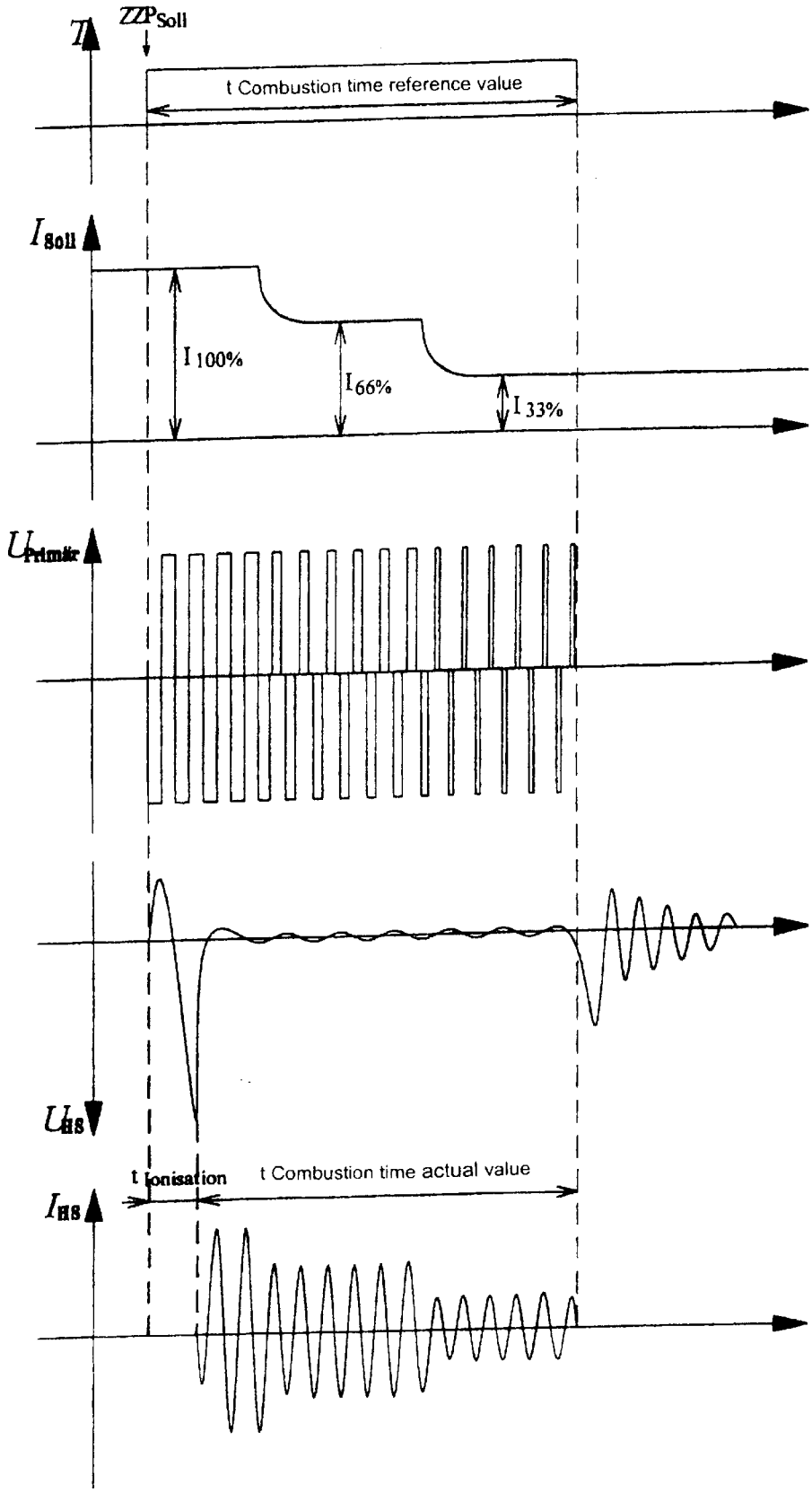

In the embodiment shown in FIG. 4, a trigger input 14 is also provided by way of a round logic gating circuit 13, which trigger determines the beginning and end of an ignition spark. The trigger signal T is shown in FIG. 5 as the uppermost drawing.

What is claimed is:

1. Ignition system with an ignition coil that is supplied on the primary side by a high frequency source, wherein the voltage output by the high frequency source is pulse width modulated and there is provided a means for picking up the actual value of the secondary side current, characterised in that a regulating means is provided that regulates the pulse width dependent upon the measured actual value of the current on the secondary side of the ignition coil and upon a pre-selected reference value development of the current amplitude during an ignition spark.

2. Ignition system according to claim 1, wherein the frequency of the high frequency source is matched to the resonance frequency of the ignition circuit.

3. Ignition system with an ignition coil that is supplied on the primary side by a high frequency source, wherein the voltage output by the high frequency source is pulse width modulated, characterised in that there is provided a means for picking up the actual value of the secondary side ignition voltage and a regulating means that regulates the pulse width dependent upon the measured actual value of the secondary side voltage and upon a pre-selectable reference voltage value.

4. Ignition system according to claim 3, wherein the voltage regulation is such that it limits the secondary side ignition voltage to a maximum value.

5. Ignition system according to claim 3, wherein the frequency of the high frequency source is matched to the resonance frequency of the ignition circuit.

* * * * *